United States Patent [19]

Pendergast

[11] 4,025,591

[45] May 24, 1977

[54] BONDING EXPLOSIVE FILLERS WITH ANAEROBIC CURING BINDERS

[75] Inventor: Daniel O. Pendergast, Arlington, Tex.

[73] Assignee: Jet Research Center, Inc., Arlington, Tex.

[22] Filed: Nov. 10, 1975

[21] Appl. No.: 630,463

Related U.S. Application Data

[63] Continuation of Ser. No. 460,852, April 15, 1974, abandoned.

[52] U.S. Cl. ..... 264/3 R; 264/3 C; 149/19.91; 149/19.92; 149/92; 149/93

[51] Int. Cl.[2] ..... C06B 21/00

[58] Field of Search ..... 149/19.91, 8, 19.92, 149/92, 93; 264/3 B, 3 C, 3 R

[56] References Cited

UNITED STATES PATENTS

| | | | |
|---|---|---|---|
| 2,622,277 | 12/1952 | Bonell et al. | 264/3 B |
| 2,798,799 | 7/1957 | Woyski et al. | 264/3 B |
| 3,149,012 | 9/1964 | Preckel | 264/3 B |
| 3,211,596 | 10/1965 | Kincaid et al. | 149/19.92 X |
| 3,655,836 | 4/1972 | Dehm et al. | 264/3 R |
| 3,679,781 | 7/1972 | Olson et al. | 264/3 R |
| 3,723,204 | 3/1973 | Evans | 149/19.91 |

*Primary Examiner*—Edward A. Miller
*Attorney, Agent, or Firm*—Thomas R. Weaver; John H. Tregoning

[57] ABSTRACT

An article of manufacture and a method of producing same is disclosed, wherein the article is a solid explosive composition comprised of a major portion of particulate explosive material bound together by a minor portion of a cured anaerobic binding material.

8 Claims, No Drawings

BONDING EXPLOSIVE FILLERS WITH ANAEROBIC CURING BINDERS

This is a continuation of application Ser. No. 460,852, filed Apr. 15, 1974, now abandoned.

This invention relates to explosives. It more particularly relates to explosive compositions comprised of explosive materials and binding materials. It still further relates to solid explosive compositions comprised of particulate explosive materials bound together by anaerobic curing materials.

One method which can be used for the production of articles, e.g. pellets, of solid explosives involves subjecting a given weight of an aggregate of small particles of the explosive to high compressive forces in a mold or die of some desirable shape. The application of the high compressive forces converts the loose, granular explosives to a compact form having the shape of the mold or die utilized. Pellets of explosive material produced by this method have the disadvantage of low mechanical strength.

The low mechanical strengths, characteristic of the solid explosive pellets produced by the above method, can be increased by admixing a quantity of binder material having adhesive properties with the particulate explosive material, prior to the compacting step. Binder materials which have been used include waxes, thermoplastics, and polymerizable resins. The waxes utilized have been solid materials which produce blending difficulties with the particulate explosives. The thermoplastics utilized, in addition to presenting the blending difficulties associated with the solid waxes, introduce the necessity of applying heat to the explosive — binder mixture for long mold dwell times in order to effect a satisfactory bond. Some resins utilized undergo premature polymerization at ordinary temperature and must therefore be held in refrigerated storage pending use.

Another method for binding particles of explosive material into a cohesive solid is described in U.S. Pat. No. 3,116,186. According to that patent, particulate explosive material is admixed with a binder material consisting essentially of a polyvinyl chloride — polymerizable monomer mixture. The admixture of explosive and binder material is thereafter placed in a desirable mold and heat is applied to effect polymerization of the monomer and simultaneous solution of the polyvinyl chloride.

By this invention there is provided solid, bonded explosive compositions which have the advantage of satisfactory mechanical strength while avoiding the disadvantages of storing temperature-sensitive binders, blending solids with solids, and heating binders to effect satisfactory bonds.

The solid, bonded explosive compositions of this invention consist essentially of a major portion of a particulate explosive material which is bound by a minor portion of a cured anaerobic binding material. The solid, bonded explosives can be produced without the use of heat and excessively high pressures, or extended mold dwell times, and the binder and explosive do not require cooling prior to blending and fabrication of the desired explosive article.

The anaerobic binding materials useful herein are liquid monomers which have the property of polymerizing rapidly and spontaneously to the solid state upon the exclusion of air or oxygen. These anaerobic binding materials have a long shelf life in the liquid state as long as contact with air is maintained. The anaerobic binding materials are more fully discussed hereinafter.

A currently preferred process for the production of the solid, bonded explosive composition of this invention comprises mixing, for a time sufficient to produce a blend of substantially uniform proportions, a suitable quantity of the liquid anaerobic binder with a suitable quantity of particular explosive under mixing conditions which entrain air or oxygen in the mixture. A satisfactory blend of substantially uniform proportions is obtained when the blend appears to be uniform by simple visual inspection. Subsequent to mixing, the uniform blend is placed in a mold having the desired shape of the completed solid explosive article and the blend is thereafter compressed to initiate curing, i.e. polymerization, of the anaerobic binder. The blend is subjected to compression in the mold, i.e. dwell time, for only a very short period of time, for example up to about 3 seconds. The dwell time required is merely that length of time necessary to exclude oxygen from the mixture in order to initiate polymerization of the anaerobic binder. Curing of the binder after polymerization initiation, however, is not necessarily completed while the blend is being pressed. Curing can proceed under ambient conditions after the molded article is removed from the mold and curing can continue for up to several days thereafter. Subsequent use of the molded explosive, including further processing or detonation, is not dependent on completion of the cure.

Reference was made in the preceeding paragraph to mixing a suitable quantity of the liquid anaerobic binder with a suitable quantity of particular explosive. In functional terms, suitable quantities of each material are those quantities which, when mixed, will produce a blend which can be characterized as being a dry mixture of free-flowing granular or particulate solids. In negative terms, the blend should not be liquid or sticky. The reason for these requirements is that conventional solids-handling equipment can not be utilized if the blend is not dry and free-flowing. Accordingly, such a desirably dry blend can be produced if the weight ratio of liquid anaerobic binder to dry explosive material is in the range of about 25:75 to about 0.01:99.99, preferably 20:80 to 1:99, and still more preferably about 15:85 to 1:99. The most preferred ratio for practical handling is in the range of 3 parts by weight binder to 97 parts by weight explosive to 1 part by weight binder to 99 parts by weight explosive, i.e. 3:97 to 1:99.

After the uniform blend of anaerobic binding material and explosive material is prepared, the blend can be immediately pressed to initiate curing or it can be stored under ambient conditions for an indefinite period of time pending use. The blend will not cure in storage so long as contact between the blend and air is maintained. One technique for maintaining such air contact involves leaving air space in the storage container which can be accomplished by failing to completely fill the storage container. Constant stirring or maintaining air moving through the blend is not required.

Any mixing operation which does not feature deliberate attempts to avoid the entrainment of air in the blend can be used herein. Thus, conventional solids mixing operations, such as tumbling, paddling, and stirring in the presence of air are, for purposes of this invention, mixing conditions which will entrain air or oxygen in the mixture.

It is convenient, but not required, in order to provide the desired blend of substantially uniform proportions, to dilute the anaerobic binder with a solvent and thereafter to mix the solvent-diluted binder with the explosive material. The solvent employed can be any substituted or unsubstituted aliphatic or aromatic organic solvent having in the range of from 1 to 10 carbon atoms. Examples of such solvents include, but are not limited to methanol, ethanol, propanol, methyl ethyl ketone, ethyl ether, trichloroethane, trichloroflormethane, benzene, toluene, xylene, naphthalene and the like. If a solvent is used to prepare the blend, the solvent is preferably removed from the blend, such as by evaporation, prior to the pressing operation. The quantity of solvent which can be used is in the range of from about 0 to 99, preferably 0 to 5, parts by weight solvent per one part by weight binder.

The molds utilized can be any of those used in the production of explosive articles. The mold volume is predicated upon the bulk density of explosive to be pressed when it is in the mold in its unconsolidated condition, i.e. in its condition prior to pressing. The mold can be of any desirable shape, it being understood that the desired shape of the finished explosive article is determined by the shape of the mold cavity.

After the blend of binder and explosive material is placed in the mold, it is then compressed for a time sufficient to initiate cure. As mentioned previously, curing of the anaerobic binding material will not proceed in the presence of air, accordingly pressing effectively eliminates the presence of air by causing entrained air to vent from the mold and by reducing the size of air cavities in the loose blend. A majority of entrained air escapes by venting and air which does not escape the blend is decreased in volume to such an extent as to render negligible the quantity of air retained in the blend. This in effect excludes the presence of oxygen to thereby initiate cure.

The compressive forces utilized to exclude oxygen as above defined requires the application of pressures in the range of from about 2,000 to about 40,000 pounds per square inch gauge. Such pressures can be obtained from equipment conventionally utilized in the explosives art.

The explosives materials can be those materials ordinarily referred to as primary and secondary high explosives, or they can be those materials ordinarily referred to as pyrotechnics. The explosive materials, however, must be in solid particulate form. The size of explosive particulate is in the range of from about fine to 30, preferably 325 to 40, mesh on the U.S. Sieve Series scale. The weight of explosive material which can be blended with the anaerobic material is not critical; it is merely a function of the size of mixing equipment and/or the storage facilities available to maintain an inventory of anaerobic binder - explosive material blend. The weight of blend used in the molding operation is also a function of the conventional molding equipment.

Examples of explosive materials useful herein are mercury fulminate, lead azide, diazodinitrophenol, nitromannite, TNT (trinitrotoluene), tetryl (2,4,6-trinitrophenylmethylnitramine), RDX (cyclotrimethylenetrinitramine), PETN (pentaerythritol tetranitrate), HNS (hexanitrostilbene), ammonium picrate, picric acid, AN (ammonium nitrate), DNT (dinitrotoluene), EDNA (ethylenediaminedinitrate). The preferred explosives are PETN and RDX.

In one group of tests a blend of PETN and an acrylic-diester anaerobic binding material having the tradename LOCKTITE CVV-KEY FIT was prepared. The anaerobic material was hand mixed with the PETN until the blend was uniform in appearance. The ratio of anaerobic material to PETN was one gram of anaerobic material per 99 grams of PETN. The blend was stored under ambient conditions for 72 hours after mixing. No change in appearance was detected. The blend was pressed into ten 0.5 gram pellets, each pellet having a diameter of 0.375 inches, utilizing a pressure of 10,000 psig. Immediately after pressing the pellets, three of them were broken with a conventional destructive testing device. Twenty-four hours after pressing, three other pellets were broken. The results of the destructive testing are set out in Table I below:

TABLE I

| Force Required To Break Pellets Immediately After Pressing (Kilograms) | Force Required To Break Pellets 24 Hours After Pressing (Kilograms) |
|---|---|
| 3.5 | 16.5 |
| 3.5 | No breakage (Maximum force 20 kg) |
| 4.0 | 18 |

From the above it is evident that the anaerobic binder and explosive material can be prepared and stored pending further processing without sustaining any apparent damage or premature cure. It is also evident, based on the increased breaking force after 24 hours, that the pressed pellets continue to cure after pressing.

The remaining four pellets were detonated 24 hours after pressing to thereby confirm that the binder did not interfere with the detonating function of the explosive.

The anaerobic binding materials useful herein are well known in the art. The discussion to follow is a general abstract of known anaerobic curing compositions which are useful as the anaerobic binding material of this invention. The anaerobic curing compositions discussed below form no part of this invention other than their specific use described above as binding materials useful in the production of solid explosives.

Compositions which harden on exclusion of oxygen which can be utilized herein as anaerobic binding materials include those based on mixtures of catalysts and esters of methacrylic acid and catalysts and esters of acrylic acid. These catalysts are within the general class of organic hydroperoxides. Thus, for example, organic hydroperoxide catalyzed esters of acrylic or methacrylic acid, wherein the esters are produced from the acids, and cycloaliphatic alcohols lead to hardening upon exclusion of oxygen.

Esters of acrylic and methacrylic acid useful herein can be prepared from cycloalkanols having 4 to 7 carbon atoms, alkylcycloalkanols having 5 to 11 carbon atoms, cycloalkylalkanols having 5 to 11 carbon atoms, dimerized and polymerized cyclopentadiene alcohols, alkanediols having 2 to 12 carbon atoms, polyoxyethylene glycols, thiodialkylene glycols having from 4 to 8 carbon atoms, di-lower-alkanolamines and tri-lower-alkanolamines.

Specific examples of compounds within these classes are cyclohexanol, methylcyclohexanol, cyclopentanol, methylcyclopentanol, methylolcyclohexane, methylolcyclopentane, tetrahydrofurfuryl alcohol and 1,3-dioxa-2,2-dimethyl-4-methylolcyclopentane, dihydrodicyclopentadienol, ethylene glycol, diethylene glycol, triethylene glycol, thiodiethylene glycol, propylene glycol, diethanolamine and tripropanolamine.

Other compositions known to harden on the exclusion of oxygen which are therefore useful herein as the anaerobic binding material include those which comprise monomers broadly categorized herein as polymerizable polyacrylate esters which, in the presence of a suitable catalyst, polymerize to the solid state upon the exclusion of oxygen.

The polymerizable polyacrylate esters have the following general formula:

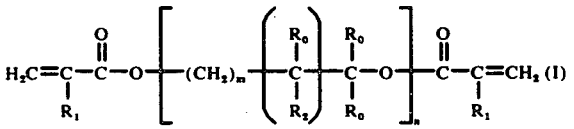

(I)

wherein $R_o$ is selected from the group consisting of hydrogen, an alkyl group having 1 to 4 carbon atoms, a hydroxyalkyl group having 1 to 4 carbon atoms, and a radical having the structure

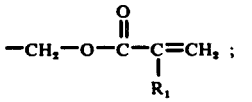

$R_1$ is selected from the group consisting of hydrogen, halogen, and an alkyl group having from 1 to 4 carbon atoms; and $R_2$ is selected from the group consisting of hydrogen, hydroxy, and a radical having the structure

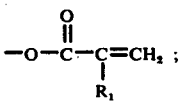

and further wherein *m* is an integer having a value in the range of from 1 to 8, *n* is an integer having a value in the range of from 1 to 20, and p is one of zero or 1. In Formula I above, $R_o$ is preferably selected from hydrogen, $-CH_3$, $-C_2H_5$, $-CH_2OH$, and

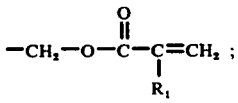

$R_1$ is preferably selected from hydrogen, chlorine, methyl and ethyl radicals; and *m* is preferably in the range of from 1 to 4.

Specific examples of compounds falling within the scope of Formula I are diethylene glycol dimethacrylate, triethylene glycol dimethacrylate, tetraethylene glycol dimethacrylate, dipropylene glycol dimethacrylate, polyethylene glycol dimethacrylate, di-(pentamethylene glycol) dimethacrylate, tetraethylene glycol diacrylate, tetraethylene glycol di(chloroacrylate), diglycerol diacrylate, diglycerol tetramethacrylate, tetramethylene dimethacrylate, ethylene dimethacrylate, neopenty glycol diacrylate and trimethylol propane triacrylate.

Formula I above is disclosed and claimed in U.S. Pat. Nos. 2,895,950; 3,041,323; 3,043,820; 3,046,262; 3,203,941; and 3,300,547. The disclosures of these patents are all incorporated herein by reference.

The polymerizable polyacrylate esters having the structure of Formula I above, in unmodified form, do not exhibit anaerobic properties, that is, they will remain liquid over long periods of time when excluded from contact with air. Accordingly, the above identified patents all disclose methods for imparting anaerobic curing characteristics to the compositions having the general formula of Formula I.

The method disclosed by U.S. Pat. No. 2,895,950 comprises adding to the polymerizable polyacrylate esters a small amount of catalyst, which is described as a latent initiator of polymerization of the monomers of Formula I inasmuch as the monomer - catalyst mixture is highly sensitive to the presence of oxygen wherein the catalyst remains ineffective to polymerize the monomer in the presence of oxygen, but the catalyst will initiate polymerization of the monomer in the absence of oxygen. These catalysts are further described as non-polymerizing organic hydroperoxides having a formula in which the atoms directly linked to the carbon atom bearing the hydroperoxide radical are selected from the group consisting of carbon, hydrogen, nitrogen and oxygen and in such cases where all of the directly linked atoms are carbon not more than two of these carbon atoms are the carbon atom of a methyl group.

Examples of these non-polymerizing organic hydroperoxide catalysts are dimethyl benzyl hydroperoxide (cumene hydroperoxide), methyl ethyl ketone hydroperoxide, and those compounds formed by oxygenation in the liquid phase of methyl butene, cetane, cylcohexane, ethylether, ethylene glycol diethyl ether, diethylene glycol dimethyl ether, tetraethylene glycol dimethyl ether, diethylene glycol, polypropylene glycol, ortho formate, trimethyl ortho formate, acetal, tetraethoxy propane, dioxane, paraldehyde, acetyl acetone, methyl n-hexyl ketone, methyl n-amyl ketone, isopropyl ketone, tetralin and tetra hydrocarbazol.

The disclosure of U.S. Pat. No. 3,300,547 enables the utilization of a broadened class of hydroperoxide catalysts with the monomers of Formula I for the preparation of anaerobic curing compositions. Such broadening is enabled by the addition of certain adhesion imparting materials and adhesion promoters to the basic monomer - catalyst mixture. The broadened class of hydroperoxides include readily hydrolyzable peresters, such as t-butyl perbenzoate. Such peresters are believed to form hydroperoxides in situ.

The adhesive imparting materials possess the dual capacity for ready assimulation into the anaerobic system without detrimental effect thereon while at the same time enhancing the dimensional stability of the bonding material upon cure, thus contributing to the adhesive ability of the anearobic composition. The materials yielding the best results are polymers having a molecular weight between two thousand and forty thousand and, more particularly, polyester resins, both modified and unmodified having such molecular weights.

Enhancement of the adhesive character of the composition may be effectuated by the incorporation into the anaerobic composition of adhesive promoters characterized by the presence of a polymerizable terminal double bond or ethylenic linkage adjacent a polar functional group of the compound. Preferably the material has only a single polar group which is selected from the class consisting of carboxyl radicals, anhydride radicals, hydroxyl radicals, cyano radicals and secondary and tertiary amino radicals. Exemplary of these adhesive promoting materials are the following acids and their anhydrides: crotonic, itaconic, nadic, methylnadic, acrylic, methacrylic and maleic, as well as materials such as cyanoethyl acrylate, acrylonitrile, hydroxyethylmethacrylate, N,N-dimethylamino ethyl methacrylate and N,N-ditertiarybutyl amino ethylacrylate. Mixtures of these materials may also be employed with good results.

The monomer catalyst system useful herein can also include the use of accelerators, such as tertiary amines, organic phosphites, organic mercaptans, ascorbic acid, quaternary ammonium salts and the like.

U.S. Pat. No. 3,046,262 discloses other compounds which are useful in the system involving the monomers of Formula I. It discloses that, by the addition of compounds selected from imides and formamides, the polymerization of the monomer can be greatly accelerated. This patent discloses that these accelerators can be used with the above mentioned organic hydroperoxide catalysts and also enables the use of the entire broad class of organic peroxides to provide a rapid anaerobic curing composition with the monomers of Formula I.

Specific examples of catalysts other than the previously mentioned organic hydroperoxides which are rendered usable by the imides and formamides are hydrogen peroxide, benzoyl peroxide and tertiary butyl perbenzoate.

The amount of catalyst necessary to obtain optimum curing will generally decrease as the amount of imide and formamide accelerator is increased.

Exemplary of the various imide and formamide accelerators are benzoic sulfimide, succinimide, phthalamide, formamide, N-substituted formamides such as N-ethyl formamide, and the metallic salts of the imides such as sodium saccharin.

Of the various accelerators, the sulfimides, having the general formula

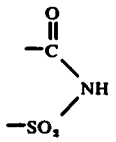

provide greatly accelerated curing characteristics and also enable the provision of compositions which exhibit excellent shelf stability over extended periods of time.

Formamide and its N-substituted derivatives provide desirable acceleration characteristics for the composition, and very great activity in combination with amine accelerators, but have the deficiency of reduction in effectiveness during storage. Thus, formamide in combination with amine accelerators such as benzylamine and triethylamine is a highly effective accelerating agent for compositions which are to be applied within relatively short times after formulation.

Conventional amine accelerators in combination with formamide and succinimide provide greatly increased activity. Generally triethylamine and tripropylamine and benzylamine are suitable for this purpose. However, amines should be excluded from sulfimide formulations if shelf stability is desired.

The disclosure of U.S. Pat. No. 3,041,322 indicates that the monomer of Formula I above can be treated to form an anaerobic curing composition by adding thereto minor amounts of tertiary butyl hydroperoxide and a triorganoamine.

The term "triorganoamine" refers to organic amines wherein all three valences of the nitrogen atom are satisfied by carbon atoms. The carbon atoms may be part of alkyl, carbocyclic or heterocyclic groups, either unsubstituted or hydroxyl-substituted. Generally, the trialkylamines and dialkylanilines are most conveniently employed. However, other compounds within the scope of the above definition are also suitable for the present invention, the requirement being that there be no free hydrogen on the nitrogen atom.

Exemplary of the various triorganoamines which can be utilized are triethylamine, tripropylamine, tributylamine, triamylamine, triphenylamine, dimethylaniline, ethyldiethanolamine, triethanolamine and piperidine.

The disclosure of U.S. Pat. No. 3,043,820 is addressed to the subject of extending the shelf life of anaerobic curing compositions containing monomers having the structure of Formula I above. This patent discloses that quinones, added in minor amounts, will greatly prolong the shelf life of the compositions during exposure to moderate amounts of air even if minor amounts of impurities which tend to produce polymerization in the presence of air are also present in the compositions. Of the various quinones, the benzoquinones and the naphthoquinones are effective and are desirable because they can be easily dissolved and added to the monomer - catalyst mixture.

Specific examples of quinones which are useful are 1,4-benzoquinone, 2,5-dihydroxy benzoquinone, 2,5-diphenyl-p-benzoquinone, 1,2-naphthoquinone and 9,10-anthraquinone.

The quinones are most easily incorporated in the monomer-catalyst composition by dissolving them in a minor amount of ethyl alcohol and then adding the required amount of the alcoholic solution to the formulation.

The quinone additives enable the utilization of concentrated hydrogen peroxide (90 percent) and the entire class of organic hydroperoxides for the preparation of anaerobic curing compositions having the characteristic of stability in the presence of air at ambient temperatures for extended periods of time. Hydrogen peroxide, however, does not have a sufficient degree of activity for commercially suitable applications and requires acceleration by an additional agent.

U.S. Pat. No. 3,203,941 discloses that anaerobic curing compositions utilizing monomers within the scope of Formula I above and appropriate catalysts can be accelerated without need for the application of heat by addition to the composition of a polyamino compound of the formula

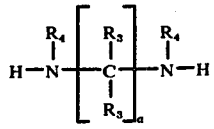

(II)

wherein $R_3$ is selected from the group consisting of hydrogen and unsubstituted alkyl groups, $R_4$ is selected from the group consisting of hydrogen, alkyl and substituted alkyl groups, and *a* is an integer equal to 2 or 3. The accelerating effect of the polyamino compound can be greatly enhanced by the inclusion therewith of an organic acid.

The polyamino compound tends to reduce the air stability of the anaerobic composition; accordingly, it is preferred that mixing of the catalyst - monomer component and the polyamino component be delayed until shortly prior to use.

Exemplary of the polyamino compounds useful are 1,2-propane diamine, 1,3-propane diamine, N,N-diethyl 1,3-propane diamine, tetraethylene pentamine, triethylene tetramine, N-(3-aminopropane) 1,3-propane diamine, ethylene diamine, and N-(2-ethanol) ethylene diamine.

The preferred polyamino compounds of the general Formula II for greatest activity are those wherein *a* is equal to 2. Specific examples of such preferred compounds are 1,2-propane diamine and ethylene diamine.

The accelerating activity of the polyamino compounds is further greatly enhanced by the incorporation therewith of an organic acid.

Generally, the enhancement afforded by the organic acid increases sharply until the full acid equivalent of the polyamino compound is present, after which the enhancement afforded by increasing amounts produces no significant additional benefit and may introduce problems of corrosion.

Exemplary of the organic acids which may be employed are 2-ethyl hexanoic, formic, acetic, propionic, hexanoic, 2-methyl hexanoic, 5-methyl hexanoic, naphthenic, lauric, linoleic and butyric.

U.S. Pat. No. 3,661,876 discloses still another composition which hardens under exclusion of oxygen which is useful in this invention. The compositions are described as being comprised of liquid esters of acids of the formula

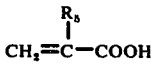

(III)

wherein $R_5$ is a member selected from the group consisting of hydrogen, lower alkyl and halogen; an organic percompound selected from the group consisting of organic hydroperoxides having from 3 to 18 carbon atoms and organic peroxides whose half life decomposition temperature after 10 hours is greater than 85° C.; and at least 10% by weight of a compound of the formula

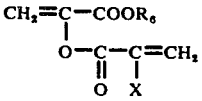

(IV)

wherein X represents a member selected from the group consisting of hydrogen, halogen and lower alkyl and $R_6$ represents a hydrocarbon having from 1 to 12 carbon atoms.

$R_6$ in the above Formula IV is preferably a methyl residue or a lower aliphatic alkyl or alkenyl residue containing 2 to 4 carbon atoms. However, $R_6$ may also be another aliphatic alkyl or alkenyl residue with 5 to 12 carbon atoms or an aromatic residue such as phenyl or phenylalkyl having from 7 to 12 carbon atoms such as benzyl or a cycloaliphatic residue possibly containing hetero atoms, such as cycloalkyl having from 4 to 7 carbon atoms and cyclooxyalkyl-alkyl having from 5 to 6 carbon atoms. For example, cyclopentyl, cylcohexyl or tetrahydrofurfuryl residues are suitable.

The mixtures according to U.S. Pat. No. 3,661,876 should furthermore contain the organic percompounds known to be suitable for this purpose. The use of organic hydroperoxides, which are derived from hydrocarbons which contain 3 to 18 carbon atoms, is advantageous. For example, tert.-butylhydroperoxide, cumenehydroperoxide, methylethylketone hydroperoxide, and diisopropylbenzene hydroperoxide are suitable. Also suitable are organic peroxides whose temperature at which the peroxides are half decomposed after 10 hours is greater than 85° to 90° C. These peroxides include, for example, tert.-butylperbenzoate, 2,2-bis-(tert.-butylperoxy)-butane, bis-(1-hydroxycyclohexyl)-peroxide and tert.-butylperoxyisopropyl carbonate.

The disclosure of U.S. Pat. No. 3,661,876 is incorporated herein by reference.

The subject matter of U.S. Pat. No. 3,720,656 is directed to still another anaerobic curing composition believed to be useful herein. The composition of U.S. Pat. No. 3,720,656 — like those of the patents discussed above — is based on an acrylic acid based ester monomer which polymerizes in the absence of oxygen. More specifically, the patent discloses an anaerobic curing composition comprised of monomers of the general formula

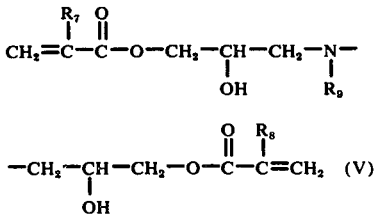

(V)

wherein $R_7$ and $R_8$ are selected from the group consisting of hydrogen and lower alkyl and $R_9$ is selected from the group consisting of lower alkyl, lower hydroxyalkyl, cyano, and lower cyanoalkyl. These monomers are reacted with a vinyl organic acid to prepare the amine salt, and are combined with a suitable initiator, inhibitor, and accelerator to prepare an anaerobic composition.

In formula V above the term "lower alkyl" refers to alkyl radicals having from 1 up to about 6 carbon atoms.

Polymerization initiators that can be employed in the compositions involving the monomers of Formula V are t-butyl perbenzoate, t-butyl peracetate, and di-t-butyl diperphthalate. The initiator must be present in an amount sufficient to initiate the polymerization of the monomer upon the exclusion of air.

The vinyl organic acid should be present in an amount equal to at least one equivalent of the acid for each equivalent of the monomer, in order to form an amine salt. The preferred vinyl organic acids are acrylic acid and the lower alkyl acrylic acids. A particularly preferred vinyl organic acid is methacrylic acid.

Because the monomers within the scope of Formula V above are relatively easily polymerized, a highly efficient inhibitor must be employed in order to maintain shelf stability. It has been found that the trihydroxybenzenes form suitable inhibitors, and these must be present in an amount sufficient to prevent gelling of the composition for at least 10 days at 120° F. in the presence of air.

Finally, the anaerobic compositions contain an accelerator selected from the group consisting of benzhydrazide and N-aminorhodanine in order to produce rapid curing.

The disclosure of U.S. Pat. No. 3,720,656, is incorporated herein by reference.

It is to be understood that the above discussions of certain specific anaerobic composition variants is not exhaustive. Not fully discussed in this disclosure are the proportions of ingredients in the compositions, optional additives which would effect cure rates, and time, shelf life, viscosity, bond strength, and similar physical and chemical properties, and conditions of mixing and curing. Potential users are urged to consider the complete disclosures of each of the above identified patents with reference to specific problem situations.

This invention is not limited to the above described specific embodiments thereof; it must be understood therefore that the detail involved in the descriptions of the specific embodiments is presented for the purpose of illustration only, and that reasonable variations and modifications, which will be apparent to those skilled in the art, can be made in this invention without departing from the spirit or scope thereof.

Having thus described the invention, that which is claimed is:

1. A process for the production of a solid, bonded composition consisting essentially of:

mixing, in the presence of air, a solid particulate material selected from primary explosives, secondary explosives and pyrotechnics with a liquid binding material to produce a dry, free-flowing blend of granular solids, wherein said liquid binding material is comprised of a mixture of an organic peroxide catalyst and an anaerobic curing monomer selected from esters of acrylic acid, esters of methacrylic acid and polymerizable polyacrylate esters, and wherein the weight ratio of said binding material to said particulate material is in the range of about 25 to 75 to about 0.01 to 99.99;

placing at least a portion of said blend of granular solids in a mold of any desirable shape; and compressing said granular solids in said mold at a pressure sufficient to substantially exclude entrained oxygen from said blend to thereby form said solid bonded composition and to initiate curing of said binding material.

2. The process of claim 1 wherein said particulate material is selected from mercury fulminate, lead azide, diazodinitrophenol, nitromannite, trinitrotoluene, 2,4,6-trinitrophenylmethylnitramine, cyclotrimethylenetrinitramine, pentaerythritol tetranitrate, hexanitrostilbene, ammonium picrate, picric acid, ammonium nitrate, dinitrotoluene and ethylenediaminedinitrate; and said weight ratio is in the range of about 15:85 to 1:99.

3. The process of claim 1 wherein said particulate material is selected from pentaerythritol tetranitrate and cyclotrimethylenetrinitramine.

4. The process of claim 3 wherein said weight ratio is in the range of from about 3 to 97 to about 1 to 99.

5. The process of claim 1 wherein the particle size of said particulate material is in the range of less than 325 mesh to 30 mesh on the U.S. Sieve Series scale.

6. Process of claim 4 wherein said particulate material is pentaerythritol tetranitrate, said weight ratio is 1:99, and the particle size of said pentaerythritol tetranitrate is in the range of 325 mesh to 40 mesh on the U.S. Sieve Series Scale.

7. The process of claim 1 wherein said pressure applied in said mold is in the range of from about 2,000 to about 40,000 pounds per square inch and further wherein said pressure is applied for a time period of up to about 3 seconds.

8. The process of claim 1 wherein said blend of dry, free-flowing granular solids is stored under ambient conditions for an indefinite period prior to said compressing step.

* * * * *